United States Patent [19]

Lockwood

[11] 3,966,392

[45] June 29, 1976

[54] CIGARETTE LIGHTER HAVING IMPROVED VALVE MEANS

[75] Inventor: John C. Lockwood, Atlanta, Ga.

[73] Assignee: Scripto, Inc., Atlanta, Ga.

[22] Filed: Aug. 19, 1974

[21] Appl. No.: 498,305

[52] U.S. Cl. ..... 431/344; 431/254; 431/277

[51] Int. Cl.[2] ..... F23Q 2/16

[58] Field of Search ..... 431/130, 131, 142, 143, 431/150, 254, 276, 277, 344

[56] References Cited

UNITED STATES PATENTS

| | | | |
|---|---|---|---|
| 3,055,201 | 9/1962 | Smith | 431/150 |
| 3,078,010 | 2/1963 | Kaname Ichikawa et al. | 431/344 |
| 3,213,648 | 10/1965 | Racek | 431/131 |
| 3,403,963 | 10/1968 | Dexter | 431/276 |
| 3,423,160 | 1/1969 | Genoud | 431/276 |
| 3,792,963 | 2/1974 | Tricot | 431/276 |
| 3,860,385 | 1/1975 | Nakanishi | 431/254 |

*Primary Examiner*—Carroll B. Dority, Jr.
*Attorney, Agent, or Firm*—Newton, Hopkins & Ormsby

[57] ABSTRACT

A cigarette lighter is disclosed having a body defining a fuel reservoir and a threaded passageway extending from the reservoir to the body exterior. An insert is threaded at least partially into the passageway and a set of bendable tabs secured thereabout along a common plane exteriorly of the body. Stop means are provided for limiting rotary movement of the insert through engagement with a member of the set of bendable tabs bent off the common plane. A valve stem is movably disposed within a cavity in the insert with a portion of the valve stem projecting to the exterior thereof. An actuating lever is coupled with the valve stem and interlocked with a fulcrum.

6 Claims, 3 Drawing Figures

CIGARETTE LIGHTER HAVING IMPROVED VALVE MEANS

BACKGROUND OF THE INVENTION

This invention relates generally to cigarette lighters, and particularly to cigarette lighters of the type that may contain fuel under pressure which, upon operation of valve means, is emitted as a stream of gas adjacent spark generation means.

Cigarette lighters of the type just described typically comprise a body which defines a reservoir and a passageway communicating between the reservoir and the body exterior with a valve housed within the passageway. A combustible fuel such as butane may be disposed within the reservoir and the valve set in a closed position thereby sealing off the reservoir from ambient atmosphere. In this valve closed condition the fuel vapors cause the pressure within the reservoir to increase above that of ambient pressure. A pressure differential of 45 PSI is common. This elevated pressure condition within the reservoir serves to maintain most of the fuel therewithin in a liquid state which in turn serves to maximize fuel storage capacity.

The valves used in these lighters typically include both means for effecting valve actuation and means for adjustably setting the flame height. This adjustability is needed due to the extreme difficulty in uniformly assembling the valve components in mass with a precisely predetermined valve opening. With inclusion of valve adjustment means such adjustment is made after assembly at the factory to establish a flame of selected height upon valve actuation and fuel ignition. This adjustability feature is maintained even following manufacture so as to enable a user to adjust flame height to suit his individual needs or preferences as well as to compensate for subsequent decreases in fuel reservoir pressure once a substantial portion of fuel has been exhausted.

That cigarette lighters of the type just described are delivered to consumers with valve adjust means has led to numerous instances of dangerous conditions arising where consumers have selected very large valve openings and then ignited fuel emitted therethrough creating a surprisingly large flame. In addition, the valve adjust and actuation mechanisms themselves have been relatively complex and cumbersome to assemble in efficient and economical manners.

Accordingly, it is a general object of the present invention to provide a cigarette lighter having improved valve means.

More specifically, it is an object of the invention to provide a cigarette lighter having means for making relatively gross valve adjustments during manufacture, and for making relatively fine valve adjustments during subsequent consumer use.

Another object of the invention is to provide a cigarette lighter having a valve adjust means of relatively simple and economic construction.

Yet another object of the invention is to provide a cigarette lighter having valve actuating means of relatively simple and economic construction which may be assembled to the lighter in an efficient and expeditious manner.

SUMMARY OF THE INVENTION

In one form of the invention a cigarette lighter is provided having a body defining a fuel reservoir and a passageway extending from the reservoir to the body exterior. An insert is threaded at least partially into the passageway and a set of bendable tabs secured to the insert exteriorly of the body along a common plane. Stop means limit rotary movement of the insert through engagement with a member of the set of bendable tabs bent off the common plane.

In another form of the invention a cigarette lighter is provided having a body defining a fuel reservoir, a passageway extending between the reservoir and an orifice in an exterior surface of the body, and a fulcrum disposed adjacent the orifice.

A valve stem projects from within the cavity out of the orifice beside the fulcrum. A valve actuating lever is interlocked with the fulcrum in operative engagement with the valve stem.

DETAILED DESCRIPTION OF THE DRAWING

Figure 1:
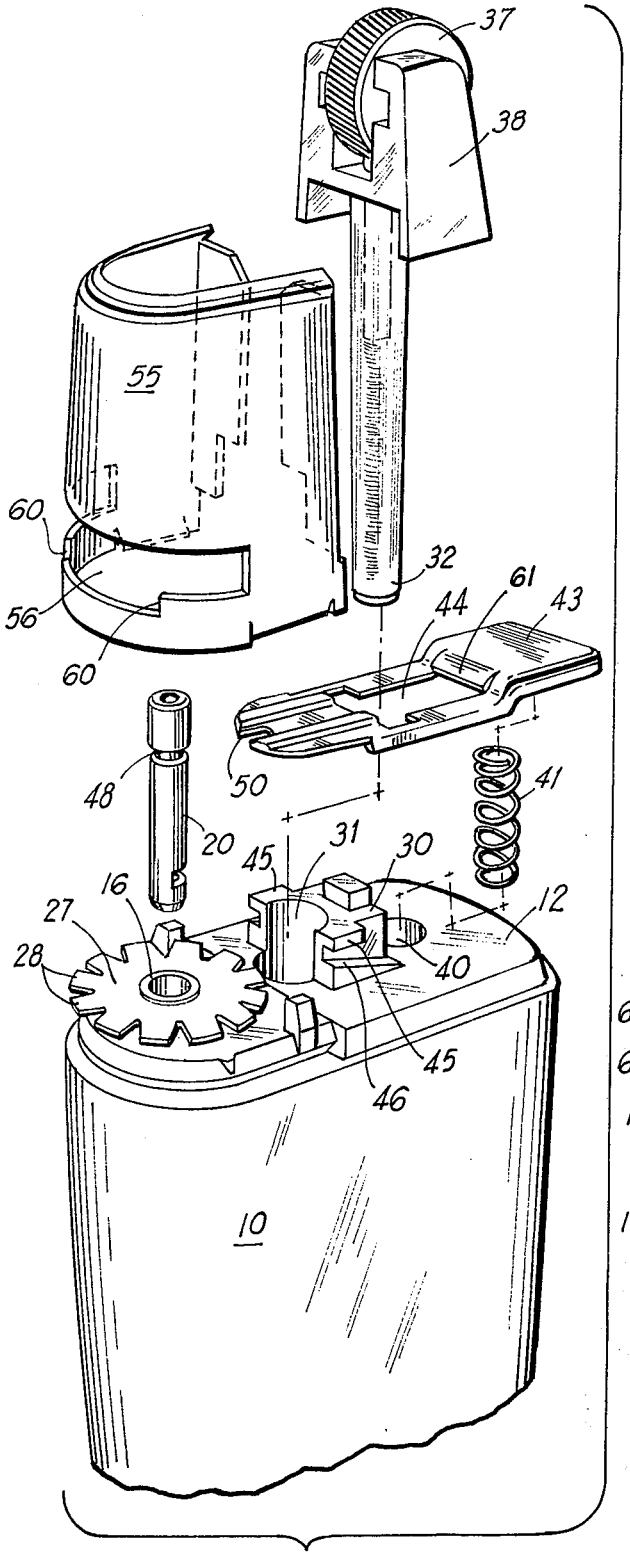
FIG. 1 is an exploded view in perspective of a cigarette lighter embodying principles of the invention in one preferred form.
Figure 2:
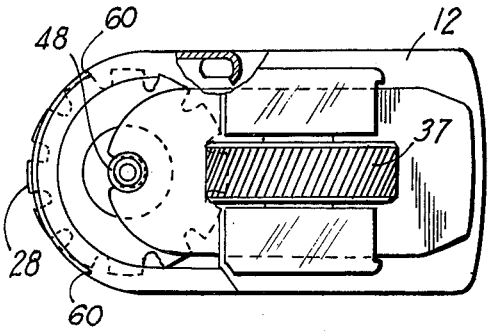
FIG. 2 is an assembled top view of the lighter depicted in FIG. 1.

Referring now in more detail to the drawing, there is shown a cigarette lighter having a housing or body 10 of generally tubular construction closed at the top by top plate 12. The body and top plate defines an interior fuel reservoir 14 and a partially threaded passageway 15 communicating between the exterior surface of the top end wall and reservoir. A threaded spindle or insert 16 is threaded into passageway 15 with an O-ring 18 compressibly disposed about the lower periphery of the insert in snug engagement with the walls of passageway 15. The insert is hollow to define a cavity in which a generally cylindrical, hollow valve stem 20 is movably disposed. A solid, rubber shut-off washer 22 is sandwiched between a step within the insert cavity and valve stem 20. A wick 24 projects from within fuel reservoir 14 up through the lowermost portion of passageway 15 into engagement with a porous washer 25 compressibly sandwiched between a lower step in passageway 15 and the bottom of insert 16. Preferably, the porous washer is composed of an open cell elastomeric material such as polyurethane. A wheel 27 is secured snugly about insert 16 above top plate 12 with a set of bendable tabs 28 disposed about the periphery thereof along a common plane.

The lighter top plate 12 has a central projection 30 about a central channel 31 in which a tube 32 is snugly seated which contains a compression spring 33 and a flint 35. A spark wheel 37 is rotably mounted to a spark wheel carrier 38 mounted atop top plate 12 straddling the body projection 30. Top plate 12 also defines a cylindrical channel 40 in which another compression spring 41 is housed.

The cigarette lighter further includes a valve actuating lever 43 having a central aperture or keyhole 44 which may be mounted to the lighter by placing the lever above top plate projection 30 and sliding the lever down about projection keys 45 which extend outwardly above top plate 12. The keyhole 44 is detailed to slide over the keys 45 after which the actuating lever may be urged along ramp 46 underneath keys 45 into engagement with annular groove 48 on valve stem 20. With an end groove 50 in the valve actuating lever engaged within the bounds of valve stem groove 48 the valve actuating lever is positioned upon an upper end of ramp 46 which serves as a fulcrum. In this position compression spring 41 biases the lever in a counterclockwise direction about the fulcrum as viewed in FIG. 1 thereby urging valve stem 16 downwardly to a valve closed position, and depending tab 61 of valve actuating lever 43 overlaps spring 41, retaining the lever in forwardly operating position.

Figure 3:
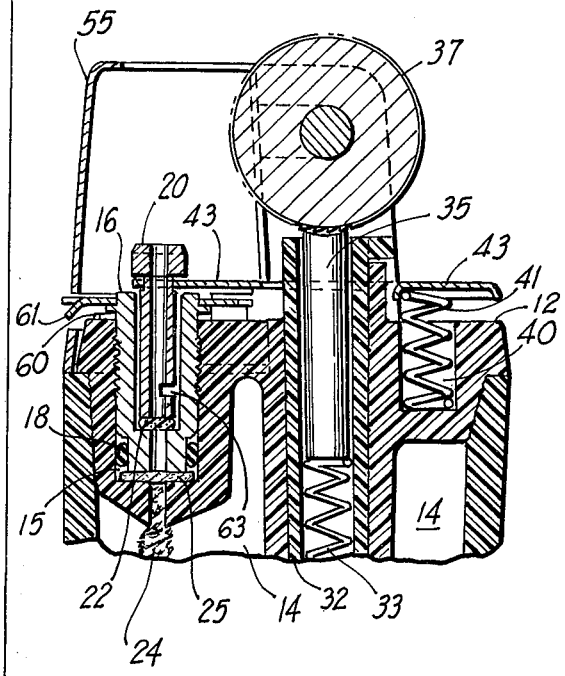
FIG. 3 is a cross-sectional view of an upper portion of the lighter shown in FIGS. 1 and 2.

A wing guard 55 having an arcuate slot 56 in an end thereof is secured atop top plane 12 about valve stem 48. The wind guard slot has a step defining two end walls 60 of an enlarged width portion of the slot. These end walls 60 serve as stops for any member of bendable tabs 28 which may be bent downwardly as tab 61 is shown in FIG. 3.

We thus see that the just described lighter may be easily assembled by threading insert 16 into passageway 15 with porous washer 25 sandwiched in compression beneath the bottom of the insert and the end wall of the passageway. Valve stem 20 may be then inserted within the cavity of the hollow insert and actuating lever 43 easily mounted in operative engagement with the valve stem without the need for auxiliary mounting components. The valve may then be adjusted by the manufacturer through rotation of the valve stem with wind guard 55 in place. Once proper adjustment is achieved one or more bendable tabs located between end wall 60 may be depressed thereby inhibiting a future user from making more than relatively minor or fine adjustments in flame height.

Once assembled and fueled, liquid fuel is drawn by wick 24 into contact with porous washer 25. Upon manual depression of valve actuation lever 43 against the bias of spring 41 valve stem 20 is urged upwardly within insert 16. With shut-off washer 22 now released the porous washer 25 is subjected to decreased ambient pressure which causes liquid fuel therewithin to vaporize and rise thereby urging shut-off washer 22 upwardly onto the bottom of raised stem 20. The fuel vapor may then pass about the lower portion of the stem, into slot 63, and up through the center of the hollow valve stem into the bounds of wind guard 55 adjacent spark wheel 37. A spark emitted by the wheel rubbing atop flint 35 will then ignite the escaping fuel vapors creating a flame which passes out through the open top of the wind guard.

It should be understood that the just described embodiment merely illustrates principles of the invention in one selected form. Many modifications may, of course, be made to this specifically illustrated embodiment without departure from the spirit and scope of the invention as set forth in the following claims.

What is claimed is:

1. A cigarette lighter having a body defining a fuel reservoir and a passageway extending from the reservoir to the body exterior; a rotatable spindle having a central bore therethrough threaded at least partially into said passageway; a windguard secured to the upper portion of said body and having a horizontal opening in its forward end with a slot in the lower portion thereof; a plurality of bendable tabs secured about said spindle exteriorly of said body and extending in a common plane except for one downwardly bent tab and extending through said windguard opening; a porous washer positioned at the inner end of said central bore, said spindle being rotated upon assembly to a point where the desired minimum compression of said porous washer is achieved where the tab adjacent one end of the slot is bent downward to restrict the withdrawal rotation of said spindle and stop means for limiting rotary movement of said spindle through engagement with ends of said slot by said bent tab for selective adjustment by the user of the flame height.

2. A cigarette lighter in accordance with claim 1 wherein said lighter further comprises a valve stem movably disposed within said spindle bore with a portion of the valve stem projecting out of said spindle bore to the exterior of said spindle.

3. A cigarette lighter in accordance with claim 2 further comprising an actuating lever coupled with said valve stem and a fulcrum to which said lever is interlocked.

4. A cigarette lighter having a body defining a fuel reservoir, a passageway extending between the reservoir and an orifice in an exterior surface of the body, and a fulcrum disposed adjacent the orifice; a valve stem projecting from within said cavity out of said orifice aside said fulcrum; a valve actuating lever interlocked with said fulcrum in operative engagement with said valve stem; and a compression spring mounted between said body and said valve actuating lever.

5. A cigarette lighter in accordance with claim 4 wherein said valve stem has a peripheral groove in which valve actuating lever is seated.

6. A cigarette lighter in accordance with claim 4 wherein said fulcrum includes a key, and wherein said valve actuating lever defines a keyhole through which said key may be inserted to interlock said valve actuating lever with said fulcrum.

* * * * *